US010501291B2

(12) United States Patent
Azzarelli

(10) Patent No.: US 10,501,291 B2
(45) Date of Patent: Dec. 10, 2019

(54) MOBILE WINCH SYSTEM

(71) Applicant: John Azzarelli, Bamberg, SC (US)

(72) Inventor: John Azzarelli, Bamberg, SC (US)

( * ) Notice: Subject to any disclaimer, the term of this patent is extended or adjusted under 35 U.S.C. 154(b) by 566 days.

(21) Appl. No.: 14/279,606

(22) Filed: May 16, 2014

(65) Prior Publication Data

US 2015/0329335 A1 Nov. 19, 2015

(51) Int. Cl.
*B66D 1/12* (2006.01)
*B66D 3/00* (2006.01)

(52) U.S. Cl.
CPC ..... *B66D 1/12* (2013.01); *B66D 3/006* (2013.01)

(58) Field of Classification Search
CPC . B66D 3/00; B66D 3/006; B66D 3/02; B66D 3/12; B62B 2203/10; B62B 2203/11; B62B 2203/13; B62B 2203/14
See application file for complete search history.

(56) References Cited

U.S. PATENT DOCUMENTS

| | | | | |
|---|---|---|---|---|
| 1,386,693 | A * | 8/1921 | Eck | B66D 3/14 254/369 |
| 3,718,317 | A * | 2/1973 | Hilmer | B66D 1/00 224/520 |
| 6,231,030 | B1 * | 5/2001 | Smith | A01G 23/006 254/324 |
| 6,481,694 | B2 * | 11/2002 | Kozak | B62B 1/14 254/325 |
| 7,913,978 | B1 | 3/2011 | Trihey et al. | |
| 8,240,683 | B1 | 8/2012 | Haslup, Sr. | |
| 2012/0056141 | A1 * | 3/2012 | Driscoll | A63B 63/008 254/362 |

* cited by examiner

*Primary Examiner* — Michael R Mansen
*Assistant Examiner* — Nathaniel L Adams
(74) *Attorney, Agent, or Firm* — Southeast IP Group, LLC.; Thomas L. Moses

(57) ABSTRACT

A mobile winching system is provided, whereby a preferred embodiment describes a motorized winch and power source mounted on a small frame that includes wheels, a handle, and a means for securing the winch system during operation. This mobile winch system provides a way to transport and operate a winch in areas that are otherwise inaccessible by traditional vehicle mounted winches.

1 Claim, 4 Drawing Sheets

MOBILE WINCH SYSTEM

BACKGROUND OF THE INVENTION

The present invention generally relates to a mobile winching system whereby a motorized winch and power source are mounted on a small frame that includes wheels, a handle, and a means for anchoring the winch system during operation. This mobile winch system provides a way to transport and operate a winch in areas that are otherwise inaccessible by traditional vehicle-mounted winches.

A winch is a mechanical device commonly used for lifting or pulling loads by means of a rope or cable that is wound around a cylinder turned by an engine, a motor, or by hand. A winch is typically comprised of a bi-directional motor, which drives a cable drum around which a cable is wrapped. One end of the cable is secured to the drum while the free end of the cable includes a hook or other hook-like device. A typical winch has a cable made of wound metal strands, rope, chain, or other similar material having high tensile strength wound around the drum. Thus when the motor turns in one direction, the cable can be fed outwardly, and conversely, while the motor turns in the opposite direction, the cable is pulled inwardly, creating a pulling force on the cable and the hook.

A winch may be used in situations where a pulling force on an item is required and the winch is relatively fixed with respect to another object. Typically, a winch can be attached to a vehicle such as all terrain vehicle (ATV), snowmobile, four-wheel drive vehicle and the like. The winch can be used in a variety of ways to provide assistance to the vehicle driver. For example, one end of the cable may be attached to a stationary object and the winch used to help move or extricate the vehicle from a stuck position. Additionally, one end of the cable may be attached to an object in order to hoist or haul it, or to remove an obstacle from the road in order for the vehicle to pass. Additionally, a winch may be used in tree rigging and removal whereby the winch is attached to a tree to facilitate pulling the tree in the desired direction in which to fall.

While the vehicle mounted winch has multiple attributes, the shortcoming is that the winch is permanently coupled to the vehicle, and the winch can only be used in conjunction with the vehicle, or where the vehicle may maneuver. Moreover, as the winches are hardwired and powered by the vehicle's battery, extended use of the winch can reduce vehicle battery voltage to below starting requirements and may strand the operator without sufficient battery power.

Therefore, it would be desirable to provide a portable system and method of operating a winch in areas inaccessible by current vehicle-mounted winches. Additionally, having an independent power source operating the winch avoids the problem of draining a vehicle battery. Further, it would be desirable to provide a small winch system that may be easily moved and handled by a single person, and which would be particularly useful for logging operations and other types of jobs that are necessarily located in remote places that provide challenges for positioning a vehicle with a mounted winch.

SUMMARY OF THE INVENTION

In accordance with one aspect of the invention, a mobile winch system is provided. The mobile winch system generally comprises a frame with wheels; a component affixed to the frame which is used to anchor the system in a fixed position; a power source selectively mounted on the frame; and a motorized winch coupled to the power source and mounted on the frame, the winch comprising a motor or engine; a drum or winding mechanism; and a cable, rope, or the like.

The frame is preferably longitudinal in shape and comprises a mounting surface and support for the winch and power source, at least two wheels, and a handle-like structure for transporting the system. The frame may be configured to resemble a dolly (hand truck), wagon, trailer, or any other similar portable system. The frame is capable of supporting the entire winch system, and may be used independently of any additional vehicle or motorized transportation means, by a single person. Optionally, the frame may include a mounting post or connection sized to receive or be part of a hitch or mount system on a vehicle such as an ATV or off-road vehicle. In this embodiment, the winch system may be driven to a beginning location, dismounted from the vehicle, and subsequently transported by hand to the desired location or position otherwise inaccessible by vehicle means.

The winch comprises a spool or drum around which a cable may be wrapped; a winding mechanism to wind the cable inward or feed the cable outward; and a motor that may be powered by gas, battery, generator, or any other power source. The free end of the cable may include a hook or similar attachment device for securing the cable to the item that is to be winched. Numerous winches are commercially available, and it should be understood that any suitable winch may be used as preferred by the user.

The motor of the winch is coupled to a power source; the type of power source being dependent upon the type of winch used. The power source may be a battery, generator, or similar power source. The winch may also be powered by a gas engine.

The frame further comprises a means for anchoring the system in a fixed position. This means preferably includes a component such as a cable, strap, rope, or the like that may be removably affixed to the frame in a location best suitable for winching operation; preferably such that the anchoring means provides a securing force that is opposite the pulling direction of the winch. This anchoring means may be wrapped around or secured to a fixed object to stabilize the winch and maximize pulling force. In one embodiment, a heavy duty nylon strap may be removably attached to the frame member, and may further wrap around or attach to a fixed object, like a large rock, stump or tree, in order to secure the winch system in place for a winching operation. This anchoring means may be removably affixed to the frame with a clevis fastener, U-bolt(s), or any other suitable device.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Figure 1:
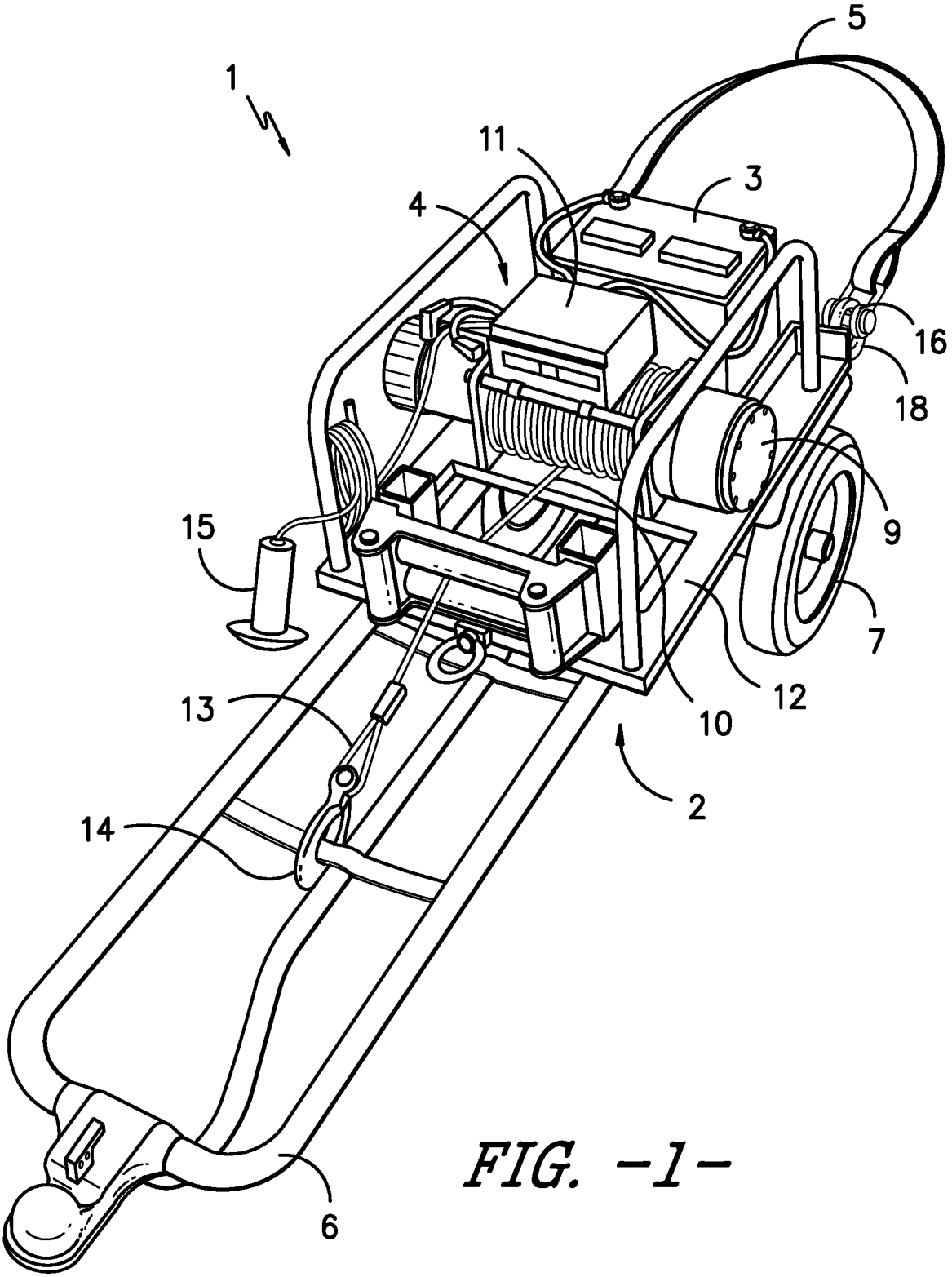
FIG. 1 is a perspective view of one embodiment of the mobile winch system in accordance with one aspect of the present invention.
Figure 2:
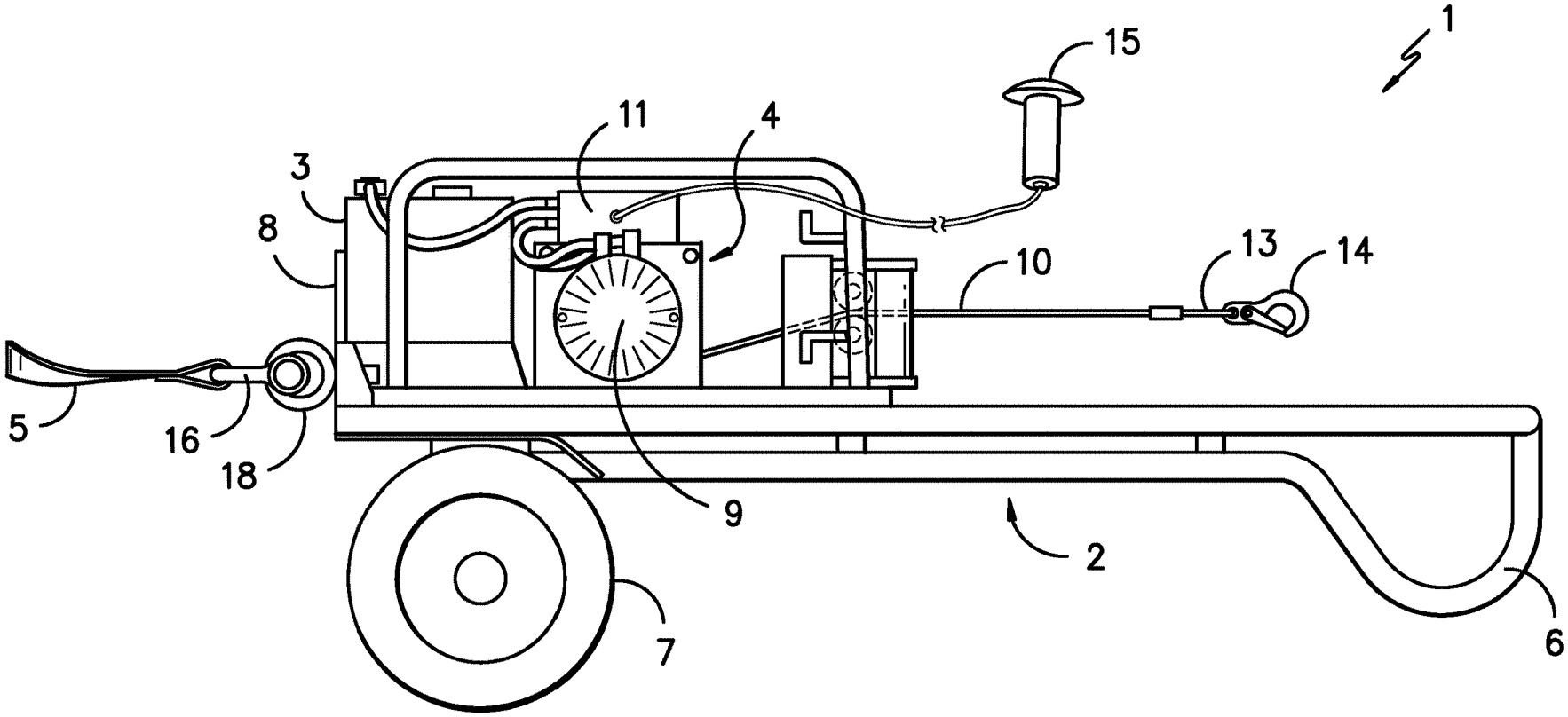
FIG. 2 is a side-view of one embodiment of the mobile winch system in accordance with one aspect of the present invention.
Figure 3:
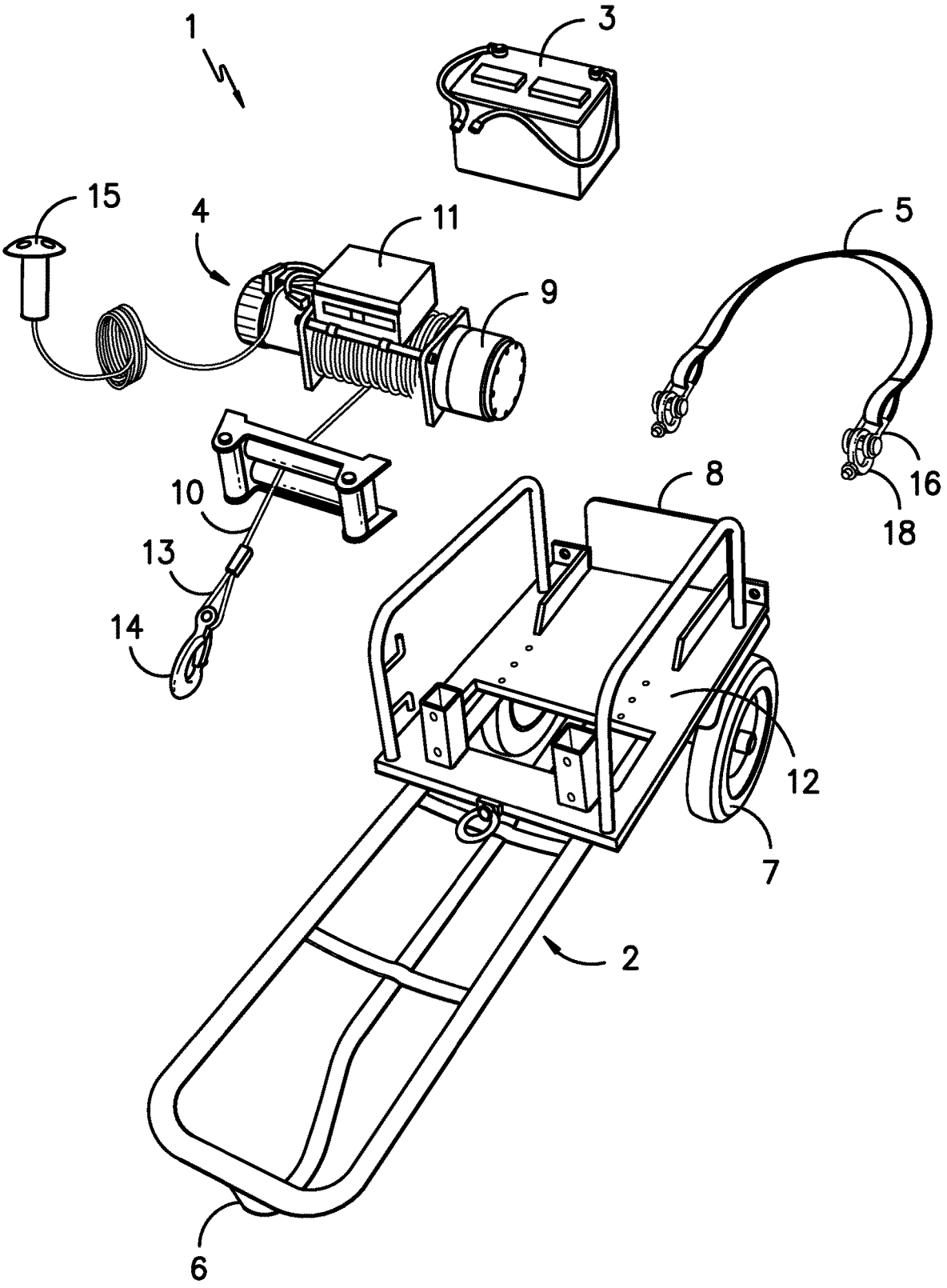
FIG. 3 is an exploded view of one embodiment of the mobile winch system in accordance with one aspect of the present invention.

FIGS. 1-4 illustrate one embodiment of a mobile winch system 1 generally comprising a frame 2, a power source 3 mounted on said frame 2, a winch, and a means for anchoring the system in a fixed position 5.

FIGS. 1-4 show a longitudinal frame 2 resembling a dolly or hand truck having a handle 6 positioned at a first end of the longitudinal frame 2, and further including a pair of free-spinning wheels 7 positioned adjacent a second end thereof. The term "free-spinning" is used herein to indicate that the wheels 7 are not driven or connected to any type of transmission or drive system, as the wheels 7 simply rotate freely in either direction about an axle or the like. A single person can easily move the mobile winch system 1 to any physical location required by simply using the handle 6 and wheel 7 system in a common and well-known manner. In a preferred embodiment, an automotive battery 3 (power source) is mounted to the frame 2 above the wheels 7 abutting the bottom carrier plate 8 (or "nose") of the dolly. In a preferred arrangement, a motorized winch 4 is operatively connected to the battery 3 and mounted to the frame 2; and the winch drum 9 is facing in an outward direction such that the free end 13 of the winch cable 10 may be pulled or extended in an outward direction relatively straight away from the winch 4 and battery 3. The winch 4 and power source 3 may be mounted to the frame 2 with bolts or the like.

As shown in FIGS. 1-4, the winch 3 preferably includes an electric motor 11, a drum/axle 9 coupled to and driven by the motor 11, a winch cable 10 wound around the drum/axle 9, and frame attachment portions 12. The motor 11 is electrically coupled to the power source 3 which may be a battery, generator, or any suitable power source. The motor 11 drives the drum/axle 9 in either direction, as desired by the user. The winch cable 10 is wound about the drum/axle 9 such that rotation of the drum/axle 9 either retracts or extends the winch cable 10 thereon, as necessary. The free end 13 of winch cable 10 preferably includes a hook 14 attached thereto for attaching to an object to be winched in any suitable manner. The winch 4 may also include a remote control 15 for operating the winch 4 at a safe distance from the winching system 1. When not in use, the free end 13 of winch cable 10 may be fastened to the frame 2 to prevent uncontrolled movement of the cable 10.

The winch 4 may be any suitable winch, many of which are commercially available, such as the Warn ZEON 10 Multi-Mount or the XT17 Portable Winch, for example. In a preferred embodiment, a motorized winch 4 can be powered by a conventional automotive battery 3. Warn manufacturer recommends a battery with a minimum rating of 650 cold cranking amps to obtain peak performance from the winch.

The frame 2 also preferably includes a means for anchoring the system 5 in a fixed position. In a preferred embodiment, as shown in FIGS. 1-4, this anchoring means 5 may be a tree trunk protector strap made of tough, high quality nylon, removably affixed to each lateral edge of the carrier plate 8 through the use of a clevis fastener 16 and cotter pin. A heavy duty metal ring 18 may be welded to the carrier plate 8 wherein the clevis fastener 16 may be removably attached to the metal ring 18. This arrangement provides that one end of the strap 5 may be released from the frame 2 allowing the strap 5 to be wrapped around a fixed object and re-attached to the frame 2. It should be understood that other suitable removable attachment means may be utilized for attaching the strap 5 to the frame 2, as desired.

Figure 4:
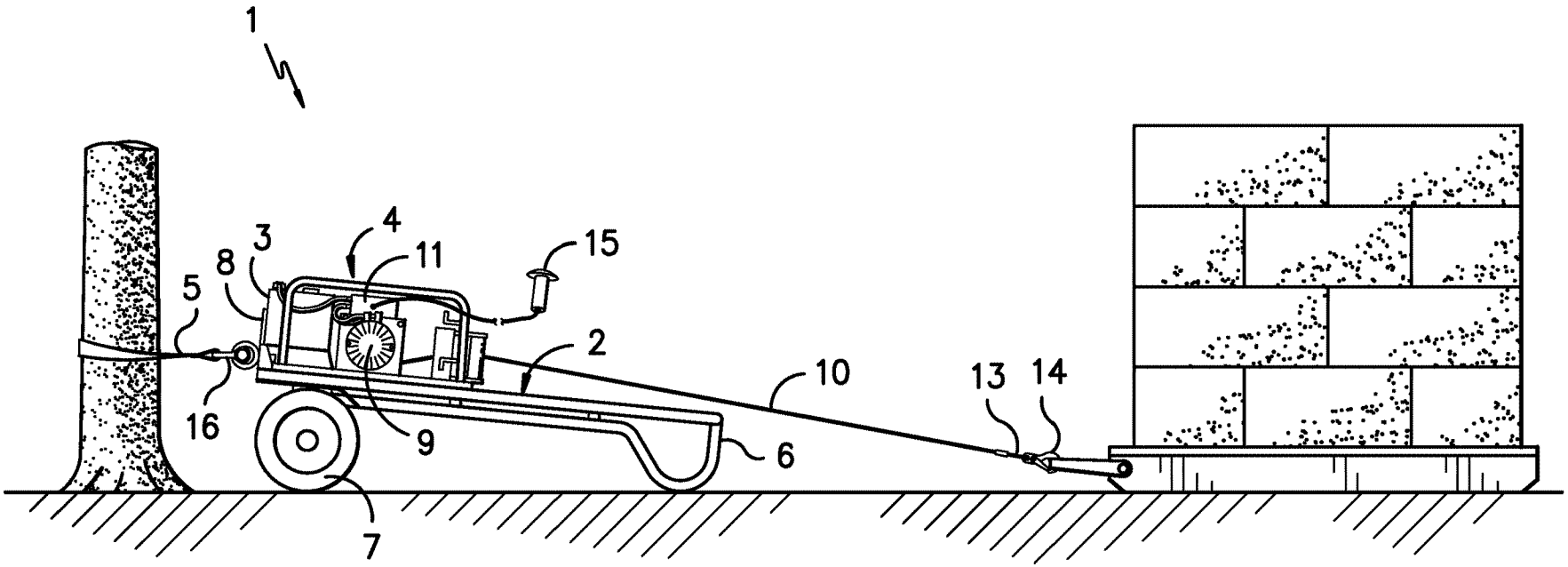
FIG. 4 is a perspective view showing one embodiment of the mobile winch system in use during a winching operation, in accordance with one aspect of the present invention.

FIG. 4 illustrates the mobile winch system 1 as it may be used during operation. The system 1 may be manually transported, such that the frame 2 is oriented in a generally acute angle with respect to the ground surface during transport, to a desired location. In other words, a user may simply tilt the frame member 2 and roll it to a desired location in the traditional and well-known method of handling a dolly or hand-truck. An important aspect of this invention is the ability to transport the winch system 1 over terrain and to locations inaccessible by current vehicle-mounted winches. During a winching operation, the system 1 is oriented in a position whereby the frame 2 is generally parallel to the ground surface. In this arrangement, the anchoring means 5 (strap) may be secured to a fixed object, such as a tree or stump, and the winch cable 10 may be extended outwardly and attached to the target object to be winched, as shown in FIG. 4. During the winching operation, it is noted that the longitudinal frame member 2 is preferably generally parallel to the ground, and the direction of force is parallel to the longitudinal direction of the longitudinal frame 2. When the strap 5 is attached to a fixed object to anchor the winch 4 in place, the winching operation may be commenced so that the direction of force of the winch 4 is generally parallel to the ground surface, and such force is pulling generally outwardly from the frame 4, as a "stretching" force rather than a "compressing force" with respect to the frame 4.

It is contemplated that the winch cable 10 may also be directed upwardly, toward the top of a tree that is being cut, for instance, and then the force exerted by the winch 4 is at a downward angle toward the winch 4. In most cases, it will be necessary to use the strap 5 (or some other anchoring means) to prevent the winch 4 from moving, because otherwise, the winching operation is likely to simply move the mobile winch system 1 toward the target object, rather than moving the target object toward the winch system 1.

It should be understood that other types of frames may be used instead of the dolly/hand-truck configuration. For instance, the frame may take the form of a wagon, having four wheels, with a handle extending from a front portion thereof, and where, in a preferred embodiment, the front wheels may pivot for turning purposes. In such a case, a strap or other anchoring means is still preferred (and in most cases necessary) for preventing movement of the system during a winching operation, in order to exert enough force on a target object to move it back toward the winch system. The winch itself may include other known features, such as a remote control tether 15 (or wireless remote control) for operation by a user at some distance from the winch system. The winding drum may have a release mechanism, so that a user can simply release the winding drum from the gears for unspooling the cable therefrom. In that case, the winding drum must be re-engaged with the gears (taken out of "neutral") after the cable has been spooled out as desired, and before commencing a winching operation.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A method for winching an object comprising the steps of:

providing a generally longitudinal frame member, wherein said frame member includes a first end opposite a second end, said first end including a handle and said second end including a pair of wheels adjacent thereto, and wherein said wheels may freely spin in a first or second direction;

providing a winching mechanism attached to said frame member, wherein said winching mechanism includes a motor, a winch drum driven by said motor, and a winch cable wound about said winch drum, and wherein the rotation of the winch drum either retracts or extends the winch cable;

providing a power source operably coupled to said motor;

providing a means for anchoring winching apparatus in a fixed position to prevent movement during operation attached to said frame member at the end opposite said handle;

manually transporting said longitudinal frame member and winching mechanism by said handle so said longitudinal frame member rolls on said wheels at an acute angle with respect to a ground surface upon which said longitudinal frame member is traversing;

positioning said longitudinal frame member and winching mechanism at a desired location for winching operation;

orienting said longitudinal frame member to be generally parallel to said ground surface;

anchoring said frame member at said desired location to prevent substantial movement during winching operation;

extending a free end of said winch cable in a generally horizontal direction;

attaching said winch cable to an object to be winched; and rotating said winch drum to retract winch cable while said longitudinal frame member is oriented generally parallel to said ground surface.

* * * * *